US010837342B2

(12) United States Patent
Kawaguchi et al.

(10) Patent No.: US 10,837,342 B2
(45) Date of Patent: Nov. 17, 2020

(54) HEAT EXCHANGE COMPONENT

(71) Applicant: NGK INSULATORS, LTD., Nagoya (JP)

(72) Inventors: Tatsuo Kawaguchi, Nagoya (JP); Takeshi Sakuma, Nagoya (JP); Makoto Yoshihara, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 15/810,669

(22) Filed: Nov. 13, 2017

(65) Prior Publication Data

US 2018/0066560 A1 Mar. 8, 2018

Related U.S. Application Data

(63) Continuation of application No. PCT/JP2016/064000, filed on May 11, 2016.

(30) Foreign Application Priority Data

May 21, 2015 (JP) ..... 2015-103956

(51) Int. Cl.
*F01N 5/02* (2006.01)
*F28F 21/04* (2006.01)
(Continued)

(52) U.S. Cl.
CPC ..... *F01N 5/02* (2013.01); *F01N 3/24* (2013.01); *F28D 7/10* (2013.01); *F28F 7/02* (2013.01);
(Continued)

(58) Field of Classification Search
CPC .... F28D 2020/0078; F28D 7/10; F28D 7/103; F28D 7/106
(Continued)

(56) References Cited

U.S. PATENT DOCUMENTS 2,900,168 A * 8/1959 Nyborg ..... F02K 9/64 165/104.31
3,450,199 A * 6/1969 Warrell ..... F28F 13/02 165/109.1
(Continued)

FOREIGN PATENT DOCUMENTS

DE 10 2010 039 281 A1 6/2011
GB 1 291 847 A 10/1972
(Continued)

OTHER PUBLICATIONS

International Search Report and Written Opinion (Application No. PCT/JP2016/064000) dated Jul. 12, 2016.
(Continued)

*Primary Examiner* — Jianying C Atkisson
*Assistant Examiner* — Jose O Class-Quinones
(74) *Attorney, Agent, or Firm* — Burr & Brown, PLLC

(57) ABSTRACT

A heat exchange component including: a pillar-shaped honeycomb structure; and a casing arranged so as to cover an outer circumferential face of the honeycomb structure. The casing includes an inner cylinder arranged so as to be fitted to the outer circumferential face of the honeycomb structure, a middle cylinder arranged so as to cover the inner cylinder, and an outer cylinder arranged so as to cover the middle cylinder such that a circumferential flow path serving as a flow path of a second fluid is formed between the inner cylinder and the outer cylinder. The circumferential flow path includes an inner circumferential flow path and an outer circumferential flow path. At least one communication hole that communicates the inner circumferential flow path and the outer circumferential flow path is formed in a portion of the middle cylinder that covers the honeycomb structure.

8 Claims, 5 Drawing Sheets

(51) Int. Cl.

| | |
|---|---|
| ***F01N 3/24*** | (2006.01) |
| ***F28D 7/10*** | (2006.01) |
| ***F28F 7/02*** | (2006.01) |
| ***F28F 13/06*** | (2006.01) |
| ***F28F 21/08*** | (2006.01) |
| ***F28F 1/14*** | (2006.01) |

(52) U.S. Cl.
CPC ..... *F28F 13/06* (2013.01); *F28F 21/04* (2013.01); *F28D 7/103* (2013.01); *F28F 1/14* (2013.01); *F28F 21/08* (2013.01); *F28F 2270/00* (2013.01)

(58) Field of Classification Search
USPC ..... 165/10, 154, 155; 60/298, 320
See application file for complete search history.

(56) References Cited

U.S. PATENT DOCUMENTS

| | | | | |
|---|---|---|---|---|
| 4,113,009 | A * | 9/1978 | Meyer et al. | F23L 15/04 110/326 |
| 4,284,133 | A * | 8/1981 | Gianni | F28D 7/106 165/133 |
| 5,540,278 | A * | 7/1996 | Chiba | F28F 9/182 165/175 |
| 6,092,590 | A * | 7/2000 | Suttrop | B64G 1/50 165/154 |
| 7,191,824 | B2 * | 3/2007 | Wu et al. | F02B 29/0462 165/141 |
| 8,522,537 | B2 | 9/2013 | Lee et al. | |
| 2009/0038302 | A1 * | 2/2009 | Yamada | F01N 3/0205 60/320 |
| 2010/0205946 | A1 * | 8/2010 | Fukudome | F01N 3/2889 60/298 |
| 2013/0133855 | A1 * | 5/2013 | Kim | F28F 1/40 165/41 |
| 2013/0248159 | A1 * | 9/2013 | Yoshida | B01D 46/2429 165/154 |
| 2014/0020877 | A1 * | 1/2014 | Suzuki | F01N 3/2828 165/181 |
| 2014/0102683 | A1 | 4/2014 | Kawaguchi et al. | |
| 2015/0241132 | A1 * | 8/2015 | Yanachi | F25B 40/00 165/154 |
| 2016/0003550 | A1 * | 1/2016 | Tokuda | F28F 21/04 165/140 |
| 2016/0341489 | A1 * | 11/2016 | Ichiyanagi | F28F 1/04 |

FOREIGN PATENT DOCUMENTS

| | | | | |
|---|---|---|---|---|
| JP | 2004-176934 | A1 | 6/2004 | |
| JP | 2007-247556 | A1 | 9/2007 | |
| JP | 2009-250107 | A1 | 10/2009 | |
| JP | 2012-037165 | A1 | 2/2012 | |
| JP | 2013-185806 | A1 | 9/2013 | |
| JP | 2015-042934 | A1 | 3/2015 | |
| WO | 2007/105815 | A1 | 9/2007 | |
| WO | 2014/148584 | A1 | 9/2014 | |
| WO | WO-2015182526 | A1 * | 12/2015 | F02G 5/02 |

OTHER PUBLICATIONS

German Office Action (with English translation), German Application No. 11 2016 002 290.5, dated Mar. 30, 2020 (9 pages).

* cited by examiner

HEAT EXCHANGE COMPONENT

BACKGROUND OF THE INVENTION

1. Field of the Invention

The present invention relates to a heat exchange component. More specifically, the present invention relates to a heat exchange component capable of switching promotion and suppression of heat exchange between two kinds of fluids without external control.

2. Description of Related Art

In recent years, there has been a demand for improvement of fuel efficiency of automobiles. In particular, there is expectation for a system that reduces a friction loss by warming up cooling water, engine oil, ATF (automatic transmission fluid), and the like at an early stage in order to prevent deterioration of fuel economy when an engine is cold such as when the engine is started. In addition, there is expectation for a system that heats a catalyst to activate an exhaust gas purifying catalyst at an early stage.

An example of such a system is a heat exchanger. The heat exchanger is a device including a component (heat exchange component) that performs heat exchange by causing a first fluid to pass through the inside and a second fluid to pass through the outside. In such a heat exchanger, it is possible to effectively utilize heat by exchanging heat from a high temperature fluid (for example, an exhaust gas) to a low temperature fluid (for example, cooling water).

Patent Document 1 discloses a heat exchange component capable of improving fuel efficiency of an automobile in the case of being used for recovering exhaust heat from an exhaust gas and heating an engine in the automobile field. However, the heat exchange component of Patent Document 1 has a structure in which the exhaust heat is constantly recovered from a first fluid (for example, the exhaust gas) to a second fluid (for example, cooling water), and thus, the exhaust heat is recovered even when there is no need to recover the exhaust heat in some cases. Thus, it is necessary to increase the capacity of a radiator which is configured to release the exhaust heat recovered when there is no need to recover the exhaust heat. In addition, when the amount of heat exchanged from the first fluid to the second fluid increases, the second fluid (for example, cooling water) boils in some cases.

Patent Document 2 describes a heat exchanger that recovers heat of an exhaust gas of an engine. Further, the heat exchanger is a heat exchanger that suppresses boiling and vaporization of cooling water of the engine when the heat of the exhaust gas of the engine is recovered to the cooling water. The heat exchanger described in Patent Document 2 is configured such that an exhaust gas passage and a first medium passage are adjacent to each other with a second medium passage therebetween and the second medium passage is filled with a second medium in a liquid phase at the time of promoting heat exchange between the exhaust gas and a first medium. Thus, according to the heat exchanger described in Patent Document 2, it is possible to more gently promote the heat exchange while suppressing boiling and vaporization of the first medium by heat exchange utilizing convection of the second medium in the liquid phase as compared with the case of directly performing heat exchange without the intervention of the second medium. In addition, the heat exchanger is configured to fill the inside of the second medium passage with a gas at the time of suppressing the heat exchange between the exhaust gas and the first medium. Thus, according to the heat exchanger, it is possible to further suppress the boiling and vaporization of the first medium as compared with the above-described heat exchange with the intervention of the second medium in the liquid phase.

CITATION LIST

Patent Documents

[Patent Document 1] JP-A-2012-037165
[Patent Document 2] JP-A-2013-185806

SUMMARY OF THE INVENTION

Problem to be Solved by the Invention

In the heat exchanger described in Patent Document 2, however, there is a problem that a structure of the heat exchanger becomes complicated and a size of the heat exchanger increases because it is necessary to provide a second circulation passage, a refrigerant tank, and the like. In addition, the first medium and the second medium are required and are configured not to be mixed, and thus, it is necessary to independently control the flow of the two kinds of media. In addition, it is necessary to open a cock of the refrigerant tank and operate a pump in order to cause the second medium expelled to the refrigerant tank to return to the second medium passage again, and there is a problem that extra energy is consumed to perform such an operation. For example, the above-described heat exchanger disclosed in Patent Document 2 is configured such that the second medium as a residual liquid is expelled to the second circulation passage and the refrigerant tank when the second medium is vaporized and the second medium passage is filled with a gas of the second medium. In addition, a check valve is provided such that the second medium expelled to the second circulation passage does not return to the second medium passage. Therefore, the heat exchanger described in Patent Document 2 has the extremely complicated configuration, and control of the heat exchanger is complicated so that there is a request for development of a heat exchange component which has a simple configuration and is easy to control.

The present invention has been made in view of such problems. According to the present invention, provided is a heat exchange component capable of switching promotion and suppression of heat exchange between two kinds of fluids without external control.

Means for Solving the Problem

In order to solve the above-described problems, the present invention provides the following heat exchange component.

According to a first aspect of the present invention, a heat exchange component is provided including: a pillar-shaped honeycomb structure including a partition wall containing ceramic as a main component; and a casing arranged so as to cover an outer circumferential face of the honeycomb structure, wherein a plurality of cells extending from a first end face to a second end face and serving as flow paths of a first fluid are defined and formed by the partition wall in the honeycomb structure, the casing includes an inner cylinder arranged so as to be fitted to the outer circumferential face of the honeycomb structure, a middle cylinder arranged so as to cover the inner cylinder, and an outer cylinder arranged so as to cover the middle cylinder such that a circumferential flow path serving as a flow path of a second fluid is formed between the inner cylinder and the outer cylinder, the circumferential flow path includes an inner circumferential flow path formed between at least a part of the inner cylinder and at least a part of the middle cylinder and an outer circumferential flow path formed between at least a part of the middle cylinder and at least a part of the outer cylinder, and at least one communication hole that communicates the inner circumferential flow path and the outer circumferential flow path is formed in a portion of the middle cylinder that covers the honeycomb structure.

According to a second aspect of the present invention, the heat exchange component according to the first aspect is provided, wherein a ratio of an opening area of the communication hole formed in the portion of the middle cylinder that covers the honeycomb structure relative to an area of the portion of the middle cylinder that covers the honeycomb structure is 50% or less.

According to a third aspect of the present invention, the heat exchange component according to the first or second aspects is provided, wherein a plurality of the communication holes are formed in the portion of the middle cylinder that covers the honeycomb structure.

According to a fourth aspect of the present invention, the heat exchange component according to the third aspect is provided, wherein an opening area of one of the communication holes is 0.5 to 5000 $mm^2$.

According to a fifth aspect of the present invention, the heat exchange component according to any one of the first to fourth aspects is provided, wherein a distance between the inner cylinder and the middle cylinder in a radial direction of the honeycomb structure is a length corresponding to 0.1 to 10% of a diameter of the honeycomb structure.

According to a sixth aspect of the present invention, the heat exchange component according to any one of the first to fifth aspects is provided, wherein a mesh member is arranged at a location where the communication hole is formed in the middle cylinder between the inner cylinder and the middle cylinder.

According to a seventh aspect of the present invention, the heat exchange component according to any one of the first to sixth aspects is provided, wherein the communication hole is formed at a position corresponding to an end portion of the honeycomb structure.

According to an eighth aspect of the present invention, the heat exchange component according to the seventh aspect is provided, wherein the communication hole is formed in an annular shape so as to surround an outer circumference of the honeycomb structure.

According to a ninth aspect of the present invention, the heat exchange component according to any one of the first to eighth aspects is provided, wherein the casing includes two or more of the middle cylinders such that the two or more middle cylinders define and form one or more intermediate circumferential flow paths formed between the inner circumferential flow path and the outer circumferential flow path, an inner communication hole which communicates the inner circumferential flow path and the intermediate circumferential flow path is formed, as the communication hole, in the middle cylinder on the inner cylinder side among the two or more middle cylinders, and an outer communication hole which communicates the intermediate circumferential flow path and the outer circumferential flow path is formed, as the communication hole, in the middle cylinder on the outer cylinder side.

Effect of the Invention

The heat exchange component of the present invention can switch promotion and suppression of heat exchange between two kinds of fluids without external control. For example, the heat exchange component of the present invention can switch promotion and suppression of heat exchange between the first fluid and the second fluid without external control when being used as a part of a heat exchanger that recovers exhaust heat from an exhaust gas of an engine. For example, when the "exhaust gas" as the first fluid and "refrigerant having a boiling point lower than a maximum achievable temperature of the inner cylinder (an outer circumferential face of the inner cylinder) constituting the heat exchange component" as the second fluid are caused to pass through the heat exchange component, the heat exchange is promoted in the following cases. That is, when the temperature of the inner cylinder (specifically, the outer circumferential face of the inner cylinder) constituting the heat exchange component is lower than the boiling point of the refrigerant, the heat exchange is promoted since the circumferential flow path is filled with the refrigerant in a liquid state. On the other hand, when the temperature of the inner cylinder (the outer circumferential face of the inner cylinder) constituting the heat exchange component is equal to or higher than the boiling point of the refrigerant, the heat exchange is suppressed since the refrigerant in the inner circumferential flow path boils and vaporizes and the refrigerant in a gaseous state, generated by the boiling and vaporization, is present in the inner circumferential flow path. That is, a state where the refrigerant in the liquid state is not in contact with at least a part of the surface of the inner cylinder is easily maintained due to the presence of the refrigerant in the gaseous state in the inner circumferential flow path so that the heat exchange between the first fluid and the second fluid is suppressed.

DETAILED DESCRIPTION OF THE INVENTION

Hereinafter, embodiments of the present invention will be described in detail with reference to the drawings. The present invention is not limited to the following embodiments, and it should be understood that those with changes, improvements and the like added as appropriate to the embodiment below on the basis of common knowledge of those skilled in the art within a scope not departing from the gist of the present invention are also included in the scope of the present invention.

Figure 1:
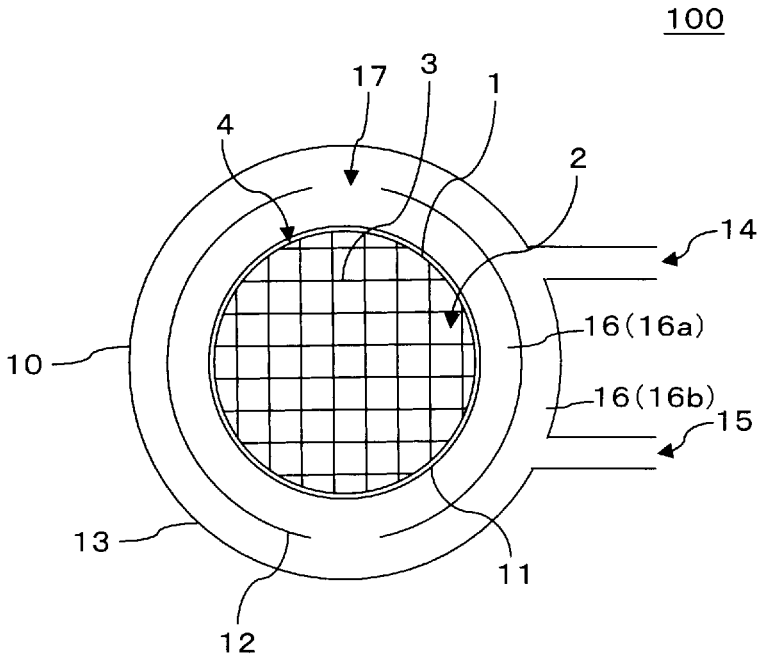
FIG. 1 is a schematic cross-sectional view showing one embodiment of a heat exchange component of the present invention, and is the cross-sectional view showing a cross section orthogonal to an extending direction of a cell of a honeycomb structure.
Figure 2A:
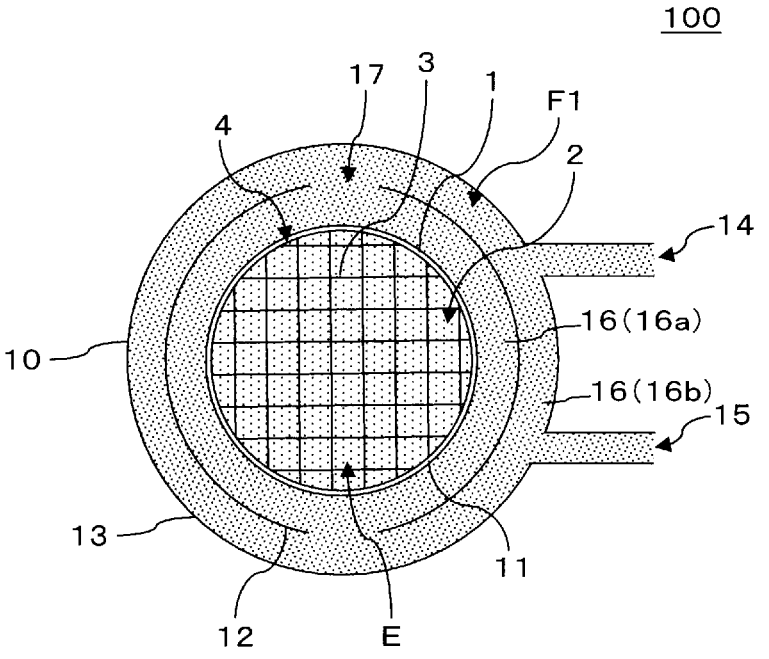
FIG. 2A is a schematic cross-sectional view showing a state (at the time of promoting heat exchange) where a circumferential flow path of the heat exchange component shown in FIG. 1 is filled with a second fluid in a liquid state and a first fluid passes through a flow path of the first fluid.
Figure 2B:
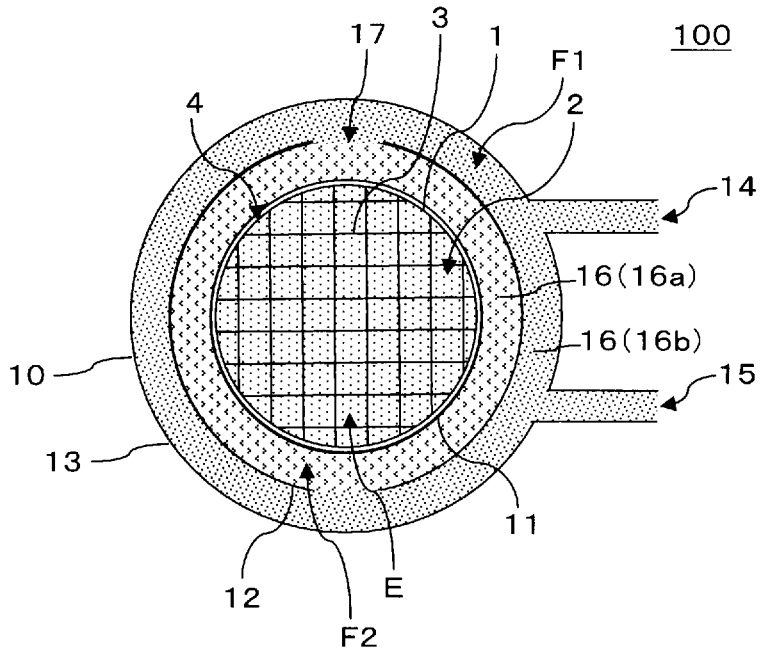
FIG. 2B is a schematic cross-sectional view showing a state (at the time of suppressing heat exchange) where an inner circumferential flow path of the heat exchange component shown in FIG. 1 is filled with a second fluid in a gaseous state, an outer circumferential flow path is filled with the second fluid in the liquid state, and the first fluid passes through the flow path of the first fluid.

(1) Heat Exchange Component:

One embodiment of a heat exchange component of the present invention is a heat exchange component 100 that includes: a pillar-shaped honeycomb structure 1 having a partition wall containing ceramic as a main component; and a casing 10 arranged so as to cover an outer circumferential face 4 of the honeycomb structure 1 as shown in FIGS. 1 to 2B. In the honeycomb structure 1, a plurality of cells 2 extending from a first end face to a second end face and serving as flow paths of a first fluid are defined and formed by a partition wall 3. The casing 10 includes an inner cylinder 11 arranged so as to be fitted to the outer circumferential face 4 of the honeycomb structure 1, a middle cylinder 12 arranged so as to cover the inner cylinder 11, and an outer cylinder 13 arranged so as to cover the middle cylinder 12. In addition, a circumferential flow path 16 serving as a flow path of a second fluid is formed between the inner cylinder 11 and the outer cylinder 13. In addition, the circumferential flow path 16 includes an inner circumferential flow path 16*a* formed between at least a part of the inner cylinder 11 and at least a part of the middle cylinder 12, and an outer circumferential flow path 16*b* formed between at least a part of the middle cylinder 12 and at least a part of the outer cylinder 13. Further, at least one communication hole 17 communicating the inner circumferential flow path 16*a* and the outer circumferential flow path 16*b* is formed in a portion of the middle cylinder 12 that covers the honeycomb structure 1. In the heat exchange component 100 shown in FIGS. 1 to 2B, an inlet 14 configured to introduce a second fluid F1 into the circumferential flow path 16 and an outlet 15 configured to emit the second fluid F1 from the circumferential flow path 16 are formed in the outer cylinder 13 of the casing 10. It is preferable that at least one pair of the inlet 14 and the outlet 15 be formed in the outer cylinder 13. In addition, "to be fitted" means that the honeycomb structure 1 and the inner cylinder 11 are fixed in the state of being fitted to each other in the present specification. Thus, the fitting between the honeycomb structure 1 and the inner cylinder 11 is not limited to a fixing method using fitting such as clearance fitting, interference fitting, and shrink fitting, but the honeycomb structure 1 and the inner cylinder 11 may be fixed to each other, for example, by brazing, diffusion bonding, and the like.

Here, the case of using the heat exchange component as a heat exchanger that recovers exhaust heat from an exhaust gas of an engine and provides the recovered exhaust heat to the engine includes a case where it is necessary to promote the recovery of exhaust heat and a case where it is necessary to suppress the recovery of exhaust heat. That is, it is necessary to promote the recovery of exhaust heat when the engine is at low temperature (a low load state) such as when the engine is started since it is desirable to recover the exhaust heat and to raise the temperature of the engine at an early stage by the recovered exhaust heat. In addition, it is necessary to suppress the recovery of exhaust heat when the engine is at high temperature (a high load state) since it is unnecessary to recover the exhaust heat and to raise the temperature of the engine by the recovered exhaust heat. When being used as a part of the heat exchanger that recovers the exhaust heat from the exhaust gas of the engine, the heat exchange component of the present embodiment is capable of switching the promotion and suppression of heat exchange of the heat exchange component (specifically, heat exchange between the first fluid and the second fluid) without external control. That is, the heat exchange component of the present embodiment is capable of switching promotion and suppression of heat exchange using a state change of the second fluid in the inner circumferential flow path. For example, when the "exhaust gas" is used as the first fluid and "refrigerant having a boiling point lower than a maximum achievable temperature of the inner cylinder (the outer circumferential face of the inner cylinder) constituting the heat exchange component" is used as the second fluid, the heat exchange is promoted in the following cases. That is, when the temperature of the inner cylinder (specifically, the outer circumferential face of the inner cylinder) constituting the heat exchange component is lower than the boiling point of the refrigerant, the circumferential flow path is filled with the liquid refrigerant. In such a case, the heat exchange between the first fluid (for example, the exhaust gas) and the second fluid (liquid refrigerant) is promoted. On the other hand, when the temperature of the inner cylinder (the outer circumferential face of the inner cylinder) constituting the heat exchange component is equal to or higher than the boiling point of the refrigerant, the refrigerant in the inner circumferential flow path boils and vaporizes and the refrigerant in a gaseous state, generated by the boiling and vaporization, is present in the inner circumferential flow path. In such a case, the heat exchange between the first fluid and the second fluid (liquid refrigerant) is suppressed. That is, the heat exchange between the first fluid and the second fluid (liquid refrigerant) is suppressed when the refrigerant in the gaseous state generated by the boiling and vaporization is present in the inner circumferential flow path. For example, a state where the refrigerant in the liquid state is not in contact with at least a part of the surface of the inner cylinder is easily maintained due to the presence of the refrigerant in the gaseous state in the inner circumferential flow path so that the heat exchange between the first fluid and the second fluid (liquid refrigerant) is suppressed. In addition, the heat exchange between the first fluid and the second fluid (liquid refrigerant) is more suppressed as a volume ratio of the refrigerant in the gaseous state generated by the boiling and vaporization account for the total volume of the inner circumferential flow path becomes higher. That is, the heat exchange between the first fluid and the second fluid (liquid refrigerant) is extremely effectively suppressed when the inner circumferential flow path is filled with the refrigerant in the gaseous state generated by the boiling and vaporization. Thus, the heat exchange is suppressed at temperature at which heat exchange is desired to be suppressed by selecting the refrigerant having a boiling point equal to or lower than the temperature at which heat exchange is desired to be suppressed and configuring the circumferential flow path such that the refrigerant in the gaseous state generated by boiling and vaporization is present in the inner circumferential flow path at the temperature at which heat exchange is desired to be suppressed. In addition, when the temperature of the heat exchange component becomes equal to or lower than the temperature at which heat exchange is desired to be suppressed (temperature at which heat exchange is desired to be promoted), the refrigerant in the gaseous state becomes a liquid, and the circumferential flow path is filled with the refrigerant in the liquid state so that the heat exchange is promoted. Incidentally, the first fluid is not limited to the exhaust gas and may be either a liquid or a gas. In addition, the expression that "the circumferential flow path, the outer circumferential flow path, or the inner circumferential flow path is filled with the refrigerant in the liquid state or the gaseous state" means that "80% or more of the total volume of the circumferential flow path, the outer circumferential flow path, or the inner circumferential flow path is occupied by the refrigerant in the liquid state or the gaseous state" in the present specification.

Here, FIG. 1 is a schematic cross-sectional view showing one embodiment of the heat exchange component of the present invention, and is the cross-sectional view showing a cross section orthogonal to an extending direction of the cell of the honeycomb structure. FIG. 2A is a schematic cross-sectional view showing a state (at the time of promoting heat exchange) where the circumferential flow path of the heat exchange component shown in FIG. 1 is filled with the second fluid in the liquid state and the first fluid passes through the flow path of the first fluid. FIG. 2B is a schematic cross-sectional view showing a state (at the time of suppressing heat exchange) where the inner circumferential flow path of the heat exchange component shown in FIG. 1 is filled with the second fluid in the gaseous state, the outer circumferential flow path is filled with the second fluid in the liquid state, and the first fluid passes through the flow path of the first fluid.

Here, states of second fluids F1 and F2 of the heat exchange component at the time of promoting the heat exchange and suppressing the heat exchange will be described in detail with reference to FIGS. 2A and 2B. In the case of using the exhaust gas as a first fluid E and the refrigerant having the boiling point lower than the maximum achievable temperature of the inner cylinder 11 (the outer circumferential face of the inner cylinder 11) as the second fluids F1 and F2, the states of the second fluids F1 and F2 of the heat exchange component at the time of promoting the heat exchange and suppressing the heat exchange are formed as follows. When the temperature of the inner cylinder 11 (the outer circumferential face of the inner cylinder 11) is lower than a boiling point of the second fluid F1, the second fluid F1 is present in a liquid state during exchange of heat (heat exchange) between the first fluid E and the second fluid F1 via the inner cylinder 11 as shown in FIG. 2A. Here, reference numeral F1 indicates the second fluid in the liquid state. When the second fluid F1 is present in the liquid state, both the inner circumferential flow path 16*a* and the outer circumferential flow path 16*b* of the circumferential flow path 16 are filled with the second fluid F1 in the liquid state. In such a state, the first fluid E and the second fluid F1 in the liquid state directly exchange heat via the inner cylinder 11. Therefore, the heat exchange between the first fluid E and the second fluid F1 in the liquid state is promoted when the temperature of the inner cylinder 11 (the outer circumferential face of the inner cylinder 11) is lower than the boiling point of the second fluid F1. On the other hand, when the temperature of the inner cylinder 11 (the outer circumferential face of the inner cylinder 11) is higher than the boiling point of the second fluid F1, vaporization of the second fluid F1 occurs on the outer circumferential face side of the inner cylinder 11, and the second fluid F2 in the gaseous state is present inside the inner circumferential flow path 16*a* as shown in FIG. 2B. In such a state, the first fluid E and the second fluid F2 in the gaseous state exchange heat via a part of the inner cylinder 11, and at the same time, the first fluid E and the second fluid F1 in the liquid state exchange heat via a part of the inner cylinder 11. Therefore, the heat exchange between the first fluid E and the second fluid F1 in the liquid state is suppressed. In addition, the heat exchange between the first fluid E and the second fluid F1 in the liquid state is suppressed as a volume ratio of the second fluid F2 in the gaseous state generated by the boiling and vaporization account for the total volume of the inner circumferential flow path 16*a* becomes higher. Here, reference numeral F2 indicates the second fluid in the gaseous state. When the vaporization of the second fluid F1 continuously occurs, the inside of the inner circumferential flow path 16*a* is gradually filled with the second fluid F2 in the gaseous state. However, the outer circumferential flow path 16*b* in the circumferential flow path 16 is partially isolated from the inner circumferential flow path 16*a* by the middle cylinder 12, and thus, the vaporization of the second fluid F1 mainly occurs in the vicinity of the outer circumferential face of the inner cylinder 11. That is, the outer circumferential flow path 16*b* is maintained in the state of being filled with the second fluid F1 in the liquid state. In such a state, the first fluid E and the second fluid F2 in the gaseous state exchange heat via the inner cylinder 11. Meanwhile, the second fluid F2 in the gaseous state has the heat capacity per unit volume that is smaller than that of the second fluid F1 in the liquid state, and thus, the heat exchange among the first fluid E and the second fluids F1 and F2 is suppressed. In other words, the first fluid E and the second fluid F1 in the liquid state, which passes through the outer circumferential flow path 16*b*, exchange heat via the second fluid F2 in the gaseous state that is present inside the inner cylinder 11 and the inner circumferential flow path 16*a* in such a state. Thus, the heat exchange is further suppressed as compared with the case where the inside of the inner circumferential flow path 16*a* is not filled with the second fluid F2 in the gaseous state. At this time, the second fluid F2 in the gaseous state inside the inner circumferential flow path 16*a* functions as a heat insulating material during the heat exchange, thereby suppressing the heat exchange between the first fluid E and the second fluid F1 in the liquid state. Incidentally, at the time of promoting the heat exchange, the second fluid F1 in the liquid state may be present in the inner circumferential flow path 16*a*, or the second fluid F2 in the gaseous state may be present in the outer circumferential flow path 16*b*. In addition, when the temperature of the first fluid E decreases, for example, the second fluid F2 in the gaseous state inside the inner circumferential flow path 16*a* undergoes a phase change to become the second fluid F1 in the liquid state.

There is no particular limitation on a shape of the communication hole formed in the middle cylinder. For example, the shape of the communication hole may be a circular shape, an elliptic shape, a polygonal shape, or the like, or may be a slit shape parallel to the extending direction of the cell, a spiral slit shape along a surface of the middle cylinder, or the like.

A ratio of an opening area of the communication hole formed in the portion of the middle cylinder that covers the honeycomb structure relative to the area of the portion of the middle cylinder that covers the honeycomb structure is preferably 50% or less, more preferably 20% or less, and particularly preferably 10% or less. Incidentally, the "area of the portion of the middle cylinder that covers the honeycomb structure" means a "total area of a substantive part and a part where the communication hole is formed in the portion of the middle cylinder that covers the honeycomb structure". With such a configuration, it is possible to suitably control the switching between suppression and promotion of heat exchange of the heat exchange component. For example, the heat exchange is suppressed as the volume ratio of the second fluid in the gaseous state generated by the boiling and vaporization account for the total volume of the inner circumferential flow path becomes higher. Further, it is possible to adjust the volume ratio of the second fluid generated by the boiling and vaporization account for the total volume of the inner circumferential flow path using the ratio of the opening area of the communication hole formed in the portion of the middle cylinder that covers the honeycomb structure relative to the area of the portion of the middle cylinder that covers the honeycomb structure. Therefore, it is possible to control the switching between suppression and promotion of heat exchange of the heat exchange component even using the ratio of the opening area of the communication hole formed in the portion of the middle cylinder that covers the honeycomb structure relative to the area of the portion of the middle cylinder that covers the honeycomb structure. Hereinafter, the "portion of the middle cylinder that covers the honeycomb structure" will be simply referred to as a "honeycomb structure covering portion" in some cases.

A plurality of the communication holes may be formed in the portion of the middle cylinder that covers the honeycomb structure (the honeycomb structure covering portion). In addition, when the plurality of communication holes are formed in the honeycomb structure covering portion, a ratio of a sum of opening areas of the plurality of communication holes formed in the honeycomb structure covering portion relative to the area of the honeycomb structure covering portion is preferably 50% or less, more preferably 20% or less, and particularly preferably 10% or less. With such a configuration, it is possible to control the switching between suppression and promotion of heat exchange of the heat exchange component. That is, the heat exchange is suppressed as the volume ratio of the second fluid in the gaseous state account for the total volume of the inner circumferential flow path becomes higher. Further, it is possible to adjust the volume ratio of the second fluid in the gaseous state generated by the boiling and vaporization account for the total volume of the inner circumferential flow path even using the ratio of the sum of the opening areas of the plurality of communication holes formed in the honeycomb structure covering portion relative to the area of the honeycomb structure covering portion. Therefore, it is possible to control the switching between suppression and promotion of heat exchange of the heat exchange component even using the ratio of the sum of the opening areas of the plurality of communication holes formed in the honeycomb structure covering portion relative to the area of the honeycomb structure covering portion.

When the plurality of communication holes are formed in the portion of the middle cylinder that covers the honeycomb structure (the honeycomb structure covering portion), an opening area of one communication hole is preferably 0.5 to 5000 $mm^2$, more preferably 1 to 1000 $mm^2$, and particularly preferably 2 to 100 $mm^2$. With such a configuration, it is possible to control the switching between suppression and promotion of heat exchange of the heat exchange component. For example, the heat exchange is suppressed as the volume ratio of the second fluid in the gaseous state generated by the boiling and vaporization account for the total volume of the inner circumferential flow path becomes higher. Further, it is possible to adjust the volume ratio of the second fluid generated by the boiling and vaporization account for the total volume of the inner circumferential flow path even using the opening area of one communication hole. Therefore, it is possible to control the switching between suppression and promotion of heat exchange of the heat exchange component even using the opening area of one communication hole.

When the plurality of communication holes are formed in the portion of the middle cylinder that covers the honeycomb structure, it is preferable to configure the heat exchange component as follows. Incidentally, the portion covering the honeycomb structure is referred to as the "honeycomb structure covering portion" in some cases. It is preferable that the ratio of the sum of the opening areas of the plurality of communication holes formed in the honeycomb structure covering portion relative to the area of the honeycomb structure covering portion be 50% or less, and the opening area of one communication hole be 0.5 to 5000 $mm^2$. It is more preferable that the ratio of the sum of the opening areas of the plurality of communication holes formed in the honeycomb structure covering portion relative to the area of the honeycomb structure covering portion be 10% or less, and the opening area of one communication hole be 0.5 to 1000 $mm^2$. Further, it is particularly preferable that the ratio of the sum of the opening areas of the plurality of communication holes formed in the honeycomb structure covering portion relative to the area of the honeycomb structure covering portion be 5% or less, and the opening area of one communication hole be 0.5 to 500 $mm^2$. With such a configuration, it is possible to highly control the switching between suppression and promotion of heat exchange of the heat exchange component.

When the plurality of communication holes are formed in the portion of the middle cylinder that covers the honeycomb structure (the honeycomb structure covering portion), the number of communication holes is preferably 2 to 1000, more preferably 10 to 1000, and particularly preferably 20 to 1000.

When the plurality of communication holes are formed in the portion of the middle cylinder that covers the honeycomb structure (the honeycomb structure covering portion), the plurality of communication holes may be provided only in a first region and a second region to be described below in a cross section orthogonal to the extending direction of the cell of the honeycomb structure. The first region and the second region have the following meaning. First, XY coordinates having a geometric center of the honeycomb structure as an origin O are virtually defined in the cross section of the heat exchange component orthogonal to the extending direction of the cell of the honeycomb structure. The XY coordinates described above are not particularly limited as long as being a coordinate system in which the X axis and the Y axis are orthogonal to each other. For example, the X axis may be a direction in which a length of the cross section of the honeycomb structure becomes the longest when the length is measured with a vernier caliper. In addition, the X axis may be a direction in which the length of the cross section of the honeycomb structure becomes the shortest when the length is measured with a vernier caliper. Next, virtual straight lines A and B passing through the origin O are drawn with respect to the above-described XY coordinates. Angles of the virtual straight lines A and B with respect to the X axis are set as +60° and −60°, respectively. Further, one of regions where the virtual straight lines A and B intersect each other at 120° in the cross section of the heat exchange component divided into four by the virtual straight lines A and B is defined as the first region, and the other region where the virtual straight lines A and B intersect each other at 120° is defined as the second region. Incidentally, the plurality of communication holes may be provided only in one of the first region and the second region or may be provided only in both the first region and the second region.

A distance between the inner cylinder and the middle cylinder in a radial direction of the honeycomb structure is preferably a length corresponding to 0.1 to 10% of a diameter of the honeycomb structure, more preferably a length corresponding to 0.1 to 5% thereof, and particularly preferably a length corresponding to 0.1 to 2.5% thereof. In addition, as another aspect, the above-described distance is preferably a length corresponding to 0.5 to 10% of the diameter of the honeycomb structure, more preferably a length corresponding to 0.5 to 5% thereof, and particularly preferably a length corresponding to 0.5 to 2.5% thereof. With such a configuration, it is possible to control the switching between suppression and promotion of heat exchange of the heat exchange component. In the heat exchange component, the heat exchange is suppressed as the volume ratio of the second fluid in the gaseous state generated by the boiling and vaporization account for the total volume of the inner circumferential flow path becomes higher. Further, it is possible to adjust the volume ratio of the second fluid in the gaseous state generated by the boiling and vaporization account for the total volume of the inner circumferential flow path even using a ratio of the distance between the inner cylinder and the middle cylinder in the radial direction of the honeycomb structure relative to the diameter of the honeycomb structure. Therefore, it is possible to control the switching between suppression and promotion of heat exchange of the heat exchange component even using the ratio of the distance between the inner cylinder and the middle cylinder in the radial direction of the honeycomb structure relative to the diameter of the honeycomb structure. Incidentally, the radial direction of the honeycomb structure indicates the direction orthogonal to the extending direction of the cell of the honeycomb structure. In addition, the diameter of the honeycomb structure is defined as a radius of a circle in the cross section orthogonal to the extending direction of the cell of the honeycomb structure when a cross-sectional shape of the honeycomb structure is the circle. In addition, when the cross-sectional shape of the honeycomb structure is a shape other than the circle, the diameter of the honeycomb structure is defined as a radius of a maximum inscribed circle inscribed in the shape. In addition, the distance between the inner cylinder and the middle cylinder indicates a shortest distance between the inner cylinder and the middle cylinder. Since the heat exchange is performed with the intervention of the refrigerant in the inner circumferential flow path at the time of heat exchange (in other words, at the time of recovering exhaust heat), there is a case where exhaust heat recovery performance deteriorates if the distance between the inner cylinder and the middle cylinder is too large. When the distance between the inner cylinder and the middle cylinder is set to the length corresponding to 0.1 to 10% of the diameter of the honeycomb structure, it is possible to improve the heat recovery amount at low water temperature without increasing the heat recovery amount at high water temperature.

Figure 5:
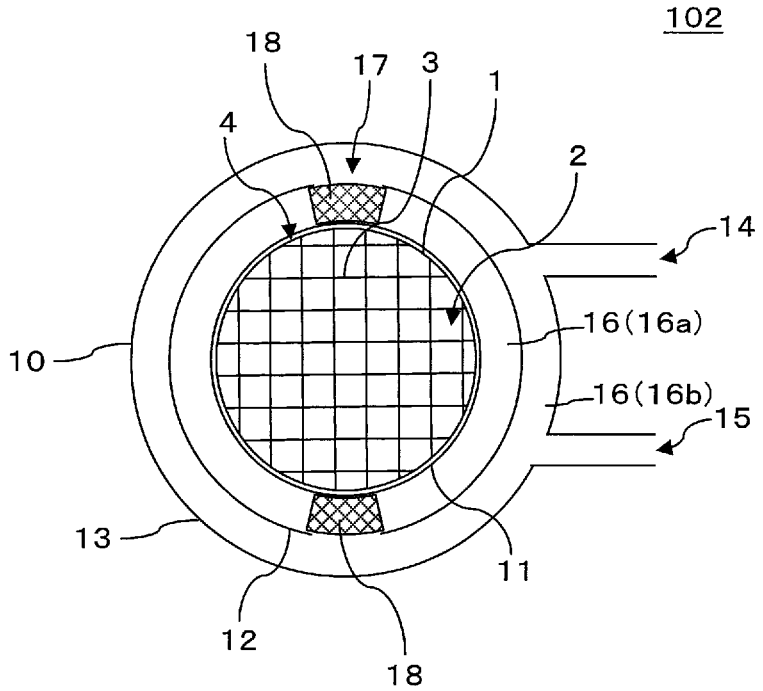
FIG. 5 is a schematic cross-sectional view showing another embodiment of the heat exchange component of the present invention, and is the cross-sectional view showing a cross section orthogonal to an extending direction of a cell of a honeycomb structure.

As shown in FIG. 5, a mesh member 18 having a mesh structure may be provided at a location where the communication hole 17 is formed in the middle cylinder 12 between the inner cylinder 11 and the middle cylinder 12. FIG. 5 is a schematic cross-sectional view showing another embodiment of the heat exchange component of the present invention, and is the cross-sectional view showing a cross section orthogonal to an extending direction of a cell of a honeycomb structure. In FIG. 5, the same constituent elements as those of the heat exchange component 100 shown in FIGS. 1 to 2B will be denoted by the same reference numerals, and the description thereof will be omitted in some cases.

According to a heat exchange component 102 as shown in FIG. 5, it is possible to increase a passage resistance of a second fluid as a liquid that tries to penetrate into the inner circumferential flow path 16*a* without changing the missing of the boiled and vaporized second fluid (for example, refrigerant in a gaseous state) inside the inner circumferential flow path 16*a*. Thus, the inside of the inner circumferential flow path 16*a* is easily filled with a gas, and it is possible to improve the heat shielding property by the inner circumferential flow path 16*a* according to the heat exchange component 102 as shown in FIG. 5. In addition, it is preferable that a certain amount of the second fluid as the liquid (for example, refrigerant in a liquid state) be introduced into the inner circumferential flow path 16*a* in order to maintain the state where the inside of the inner circumferential flow path 16*a* is filled with the gas. When the mesh member 18 is provided, it is possible to cause the second fluid as the liquid to gently flow in through the mesh of the mesh member 18. For example, when the mesh member 18 is not provided, the second fluid in the liquid state is intermittently introduced into the inner circumferential flow path 16*a* in the state of droplets in some cases. When the second fluid as the droplets boils and vaporizes at a stretch, vibration may be generated inside the heat exchange component due to sudden volume expansion or a large boiling sound may be generated in some cases. When the mesh member 18 is provided such that the second fluid as the liquid gently flows in, it is possible to effectively suppress the generation of the vibration and the boiling sound.

Figure 6:
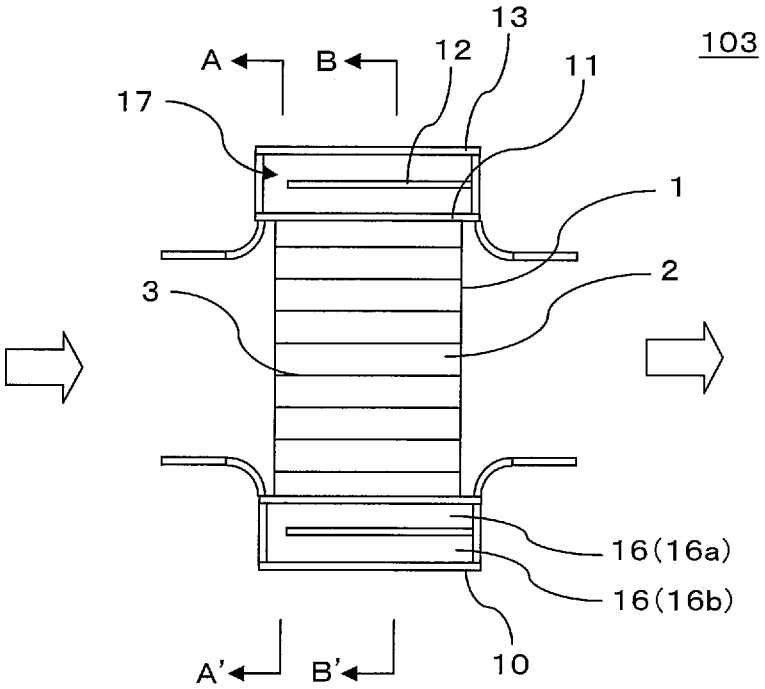
FIG. 6 is a schematic cross-sectional view showing another embodiment of the heat exchange component of the present invention, and is the cross-sectional view showing a cross section parallel to an extending direction of a cell of a honeycomb structure.
Figure 7:
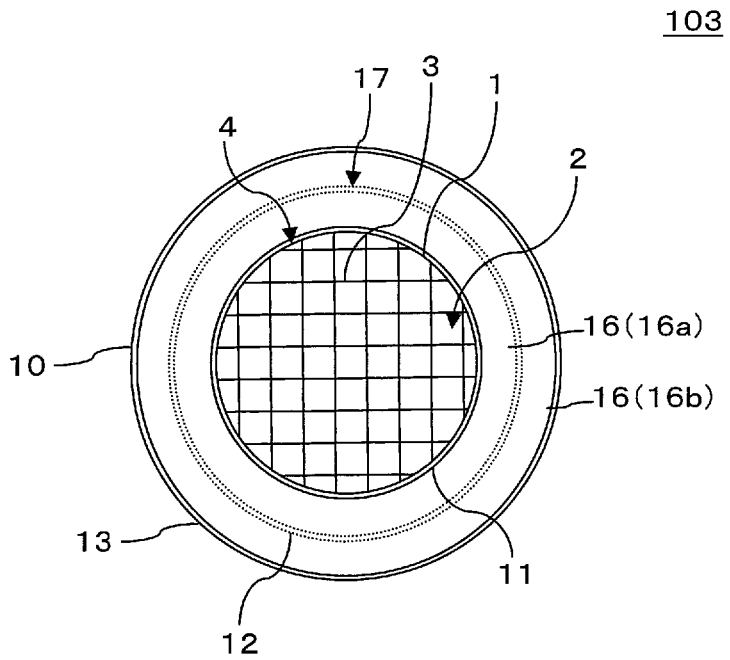
FIG. 7 is a cross-sectional view schematically showing a cross section taken along line A-A' of FIG. 6.
Figure 8:
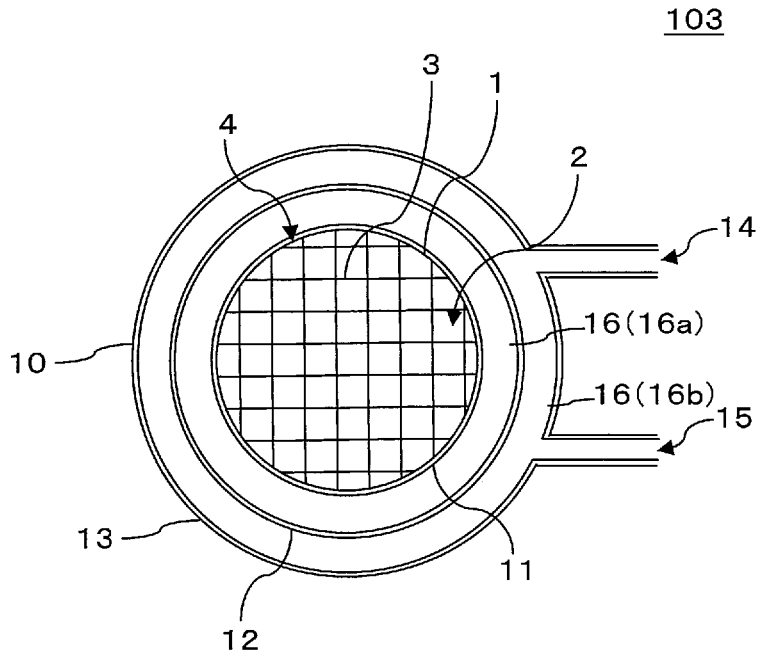
FIG. 8 is a cross-sectional view schematically showing a cross section taken along line B-B' in FIG. 6.

Although there is no particular limitation on roughness of the mesh of the mesh member 18 or the like, for example, a sieve opening of the mesh is preferably 0.02 to 4.5 mm and more preferably 0.1 to 1.0 mm. With such a configuration, it is possible to increase the passage resistance of the second fluid as the liquid without changing the missing of the boiled and vaporized second fluid in the gaseous state The communication hole 17 may be formed at a position corresponding to an end portion of the honeycomb structure 1 as in the heat exchange component 103 shown in FIGS. 6 to 8. At this time, the communication hole 17 formed at the position corresponding to the end portion of the honeycomb structure 1 may be formed into an annular shape so as to surround an outer circumference of the honeycomb structure 1. Here, FIG. 6 is a schematic cross-sectional view showing another embodiment of the heat exchange component of the present invention, and is a cross-sectional view showing a cross section parallel to an extending direction of a cell of a honeycomb structure. FIG. 7 is a cross-sectional view schematically showing a cross section taken along line A-A' of FIG. 6. FIG. 8 is a cross-sectional view schematically showing a cross section taken along line B-B' of FIG. 6. In FIGS. 6 to 8, the same constituent elements as those of the heat exchange component 100 shown in FIGS. 1 to 2B will be denoted by the same reference numerals, and the description thereof will be omitted in some cases.

Even when the inside of the inner circumferential flow path 16*a* is filled with the gas, the heat exchange component 103 shown in FIGS. 6 to 8 is capable of maintaining a "state where the second fluid as the liquid is in contact with the outer circumferential face of the inner cylinder 11" on a side of the end portion of the honeycomb structure 1. Thus, an end portion of the inner cylinder 11 is hardly heated excessively, and it is possible to effectively suppress excessive thermal expansion of the inner cylinder 11. Therefore, it is possible to effectively suppress reduction of a binding force with respect to the honeycomb structure 1 caused by the excessive thermal expansion of the inner cylinder 11 according to the heat exchange component 103 shown in FIGS. 6 to 8. That is, the heat exchange component 103 shown in FIGS. 6 to 8 can effectively prevent drop-out of or positional deviation of the honeycomb structure 1 from the inner cylinder 11 particularly in the state where the heat exchange is suppressed since the end portion of the inner cylinder 11 is continuously cooled by the second fluid.

The casing may include two or more middle cylinders and the two or more middle cylinders may define and form one or more intermediate circumferential flow paths to be formed between the inner circumferential flow path and the outer circumferential flow path. When the intermediate circumferential flow path is defined and formed, an inner communication hole communicating the inner circumferential flow path and the intermediate circumferential flow path is formed, as the communication hole, in the middle cylinder on the inner cylinder side. An outer communication hole communicating the intermediate circumferential flow path and the outer circumferential flow path is formed, as the communication hole, in the middle cylinder on the outer cylinder side. When the casing includes three or more middle cylinders and two or more intermediate circumferential flow paths are defined and formed between the inner circumferential flow path and the outer circumferential flow path, intermediate communication holes communicating the intermediate circumferential flow paths are formed as communication holes, respectively, in the middle cylinder other than the middle cylinders on the inner cylinder side and the outer cylinder side. With such a configuration, the convection generated in the second fluid becomes complicated as compared with the case where the intermediate circumferential flow path is not defined and formed when the heat exchange is performed between the first fluid and the second fluid. Thus, it is possible to effectively suppress that great large pressure is locally applied to a part of the middle cylinder and the inner cylinder, which define and form the inner circumferential flow path, due to bumping of the second fluid inside the inner circumferential flow path, for example. In addition, when the inner circumferential flow path is filled with the second fluid in the gaseous state, the following balance of forces occurs in the inner communication hole communicating the inner circumferential flow path and the intermediate circumferential flow path. That is, a force of the second fluid in the gaseous state inside the inner circumferential flow path toward the outer circumferential flow path and a force of the second fluid in the liquid state inside the outer circumferential flow path toward the inner circumferential flow path are balanced when the influence of gravity is excluded. Thus, when the force of the second fluid in the liquid state inside the outer circumferential flow path toward the inner circumferential flow path decreases, the inside of the inner circumferential flow path is more likely to be filled with the second fluid in the gaseous state. Therefore, the inside of the inner circumferential flow path is easily filled with the second fluid in the gaseous state by configuring as described above since the second fluid in the liquid state inside the inner circumferential flow path hardly flows into the inner circumferential flow path as compared with the case where the intermediate circumferential flow path is not defined and formed.

When the casing has two middle cylinders and the two middle cylinders define and form one intermediate circumferential flow path to be formed between the inner circumferential flow path and the outer circumferential flow path, the inner communication hole and the outer communication hole are preferably formed as follows. First, the middle cylinder arranged on the inner side between the two middle cylinders is defined as an "inner middle cylinder", and the middle cylinder arranged on the outer side is defined as an "outer middle cylinder". Further, one inner communication hole formed in the inner middle cylinder is defined as an "inner communication hole a", and one outer communication hole formed in the outer middle cylinder is defined as an "outer communication hole b". In addition, a normal extending radially from a central axis of the inner middle cylinder in a cross section orthogonal to the central axis of the inner middle cylinder is defined as a "normal of the inner middle cylinder". In addition, an extending direction of each normal of the inner middle cylinder will be sometimes referred to as a "normal direction of the inner middle cylinder" as appropriate. The inner communication hole a and the outer communication hole b are preferable configured such that the area of a portion where positions of mutual open ends overlap each other in the normal direction of the inner middle cylinder is 80% or less relative to an opening area of the communication hole having a larger opening area between the inner communication hole a and the outer communication hole b. The above-described ratio of the area is more preferably 50% or less, still more preferably 30% or less, and particularly preferably 0% (the mutual open ends do not overlap each other). The expression that "positions of the mutual open ends overlap each other in the normal direction of the inner middle cylinder" means the following portion. First, the "normal of the inner middle cylinder" passing through a circumferential edge of the inner communication hole a is extended to an inner face of the outer middle cylinder, and a portion on an inner face of the outer middle cylinder that is surrounded by the extended normal is defined as an overlapping range of the open ends. Further, a case where at least a part of the outer communication hole b is formed in the "overlapping range of the open ends" is defined as the case where "the positions of the mutual open ends overlap each other". In the outer communication hole b, the above-described portion formed in the overlapping range of the open ends is defined as a "portion of the outer communication hole b where the positions of the open ends overlap each other". In the inner communication hole a, the "normal of the inner middle cylinder" passing through a circumferential edge of the "portion where the position of the open ends overlap each other" of the outer communication hole b is returned to the surface of the inner middle cylinder, and a portion on the surface of the inner middle cylinder that is surrounded by the returned normal is defined as a "portion of the inner communication hole a where the open ends overlap each other". Regarding the above-described ratio of the area of the portion where the positions of the open ends overlap each other, it is obtained a ratio of the area of the "portion where the positions of the open ends overlap each other" in the communication hole having the larger opening area between the inner communication hole a and the outer communication hole b relative to the opening area of the communication hole having the larger opening area. For example, when the opening area of the outer communication hole b is large between the inner communication hole a and the outer communication hole b, it is obtained a ratio of the area of the "portion of the outer communication hole b where the positions of the open ends overlap each other" relative to the opening area of the outer communication hole b.

When the casing has three or more middle cylinders and the three or more middle cylinders define and form two or more intermediate circumferential flow paths to be formed between the inner circumferential flow path and the outer circumferential flow path, the inner communication hole and the intermediate communication hole are preferably formed as follows. First, the middle cylinder arranged on the innermost side among the three or more middle cylinders is defined as an "inner middle cylinder", and the middle cylinder arranged on the outer side than the inner middle cylinder to be closest to the inner middle cylinder is defined as an "intermediate middle cylinder". Further, one inner communication hole formed in the inner middle cylinder is defined as an "inner communication hole al", and one communication hole formed in the "intermediate middle cylinder" is defined as an "intermediate communication hole c1". Further, the "inner communication hole al" and the "intermediate communication hole c1" are preferably formed to have the same positional relationship as the "inner communication hole a" and the "outer communication hole b" described above. With such a configuration, the second fluid in the liquid state inside the outer circumferential flow path hardly flows into the inner circumferential flow path, for example, at the time of suppressing the heat exchange. Thus, the inside of the inner circumferential flow path is easily filled with the second fluid in the gaseous state at the time of suppressing the heat exchange.

As described above, when the force of the second fluid in the liquid state inside the outer circumferential flow path toward the inner circumferential flow path decreases, the inside of the inner circumferential flow path is more likely to be filled with the second fluid in the gaseous state. That is, the inside of the inner circumferential flow path is easily filled with the second fluid in the gaseous state even if the vapor pressure of the second fluid in the gaseous state is small. Thus, the configuration to decrease the force of the second fluid in the liquid state inside the outer circumferential flow path toward the inside of the inner circumferential flow path may be suitably adopted. For example, it may be configured such that the force of the second fluid in the liquid state inside the outer circumferential flow path toward the inside of the inner circumferential flow path is decreased by providing unevenness inside the outer circumferential flow path or providing a convex portion on a circumferential edge of an open end of at least one of the inner communication hole, the intermediate communication hole, and the outer communication hole.

In addition, although not shown, in the heat exchange component of the present embodiment, two or more of the heat exchange components described so far may be provided such that the two or more heat exchange components are connected in series in a flow direction of the first fluid. For example, two heat exchange components each of which has a honeycomb structure with a halved length may be provided such that the two heat exchange components are directly connected. When the two or more heat exchange components are connected in series, it is possible to reduce the heat recovery amount at the high load state where heat exchange is suppressed. Incidentally, the two or more heat exchange components may be connected at intervals in series with each other by providing pipes or the like therebetween or may be connected in a state where neighboring heat exchange components are adjacent to each other without providing the above-described pipes or the like.

In the honeycomb structure, the plurality of cells extending from the first end face to the second end face and serving as the flow paths of the first fluid are defined and formed by the partition wall. With such a configuration, it is possible to efficiently collect the heat of the first fluid flowing through the cells of the honeycomb structure and transmit the collected heat to the outside.

There is no particular limitation on an outer shape of the honeycomb structure. A cross-sectional shape of the cross section of the honeycomb structure orthogonal to the cell extending direction may be a circular shape, an elliptical shape, a quadrangular shape, or other polygonal shapes.

The partition wall of the honeycomb structure contains ceramic as the main component. The expression that "containing ceramic as the main component" means that "a mass ratio of the ceramic account for a total weight of the partition wall is 50% by mass or more".

The porosity of the partition wall is preferably 10% or less, more preferably 5% or less, and particularly preferably 3% or less. When the porosity of the partition wall is set to 10% or less, it is possible to improve the thermal conductivity. Incidentally, the porosity of the partition wall is a value measured by the Archimedes method.

The partition wall preferably contains SiC (silicon carbide) having high thermal conductivity as a main component. Incidentally, the main component means that 50% by mass or more of the honeycomb structure is SiC.

More specifically, Si-impregnated SiC, (Si+Al)-impregnated SiC, metal composite SiC, recrystallized SiC, $Si_3N_4$, SiC, and the like can be adopted as a material of the honeycomb structure.

There is no particular limitation on a cell shape in the cross section orthogonal to the extending direction of the cell of the honeycomb structure. A desired shape may be appropriately selected from among a circle shape, an elliptical shape, a triangular shape, a quadrangular shape, a hexagonal shape, and other polygonal shapes.

There is no particular limitation on cell density of the honeycomb structure (that is, the number of cells per unit area). The cell density may be appropriately designed, and is preferably in a range of 4 to 320 cells/$cm^2$. When the cell density is set to 4 cells/$cm^2$ or more, it is possible to sufficiently provide strength of the partition wall, and further, strength and effective GSA (geometric surface area) of the honeycomb structure itself. In addition, it is possible to prevent an increase in pressure loss caused when the first fluid flows by setting the cell density to 320 cells/$cm^2$ or less.

Isostatic strength of the honeycomb structure is preferably 1 MPa or more and more preferably 5 MPa or more. When the isostatic strength of the honeycomb structure is 1 MPa or more, it is possible to provide the sufficient durability of the honeycomb structure. Incidentally, an upper limit value of the isostatic strength of the honeycomb structure is about 100 MPa. The isostatic strength of the honeycomb structure can be measured according to the method of measuring isostatic fracture strength defined in the JASO standard M505-87 which is an automobile standard issued by the Society of Automotive Engineers of Japan.

The diameter of the honeycomb structure in the cross section orthogonal to the cell extending direction is preferably 20 to 200 mm and more preferably 30 to 100 mm. It is possible to improve heat exchange efficiency by setting such a diameter. When the shape of the honeycomb structure in the cross section orthogonal to the cell extending direction is not circular, a diameter of a maximum inscribed circle inscribed in the shape of the cross section of the honeycomb structure is defined as the diameter of the honeycomb structure in the cross section orthogonal to the cell extending direction.

A thickness of the partition wall of the cell of the honeycomb structure may be appropriately designed according to the purpose, and is not particularly limited. The thickness of the partition walls is preferably 0.1 to 1 mm, more preferably 0.2 to 0.6 mm. When the thickness of the partition wall is set to 0.1 mm or more, it is possible to sufficiently provide the mechanical strength and to prevent breakage caused by impact or thermal stress. In addition, when the thickness of the partition wall is set to 1 mm or less, it is possible to prevent problems such as the increase in pressure loss of the first fluid and the decrease in heat exchange efficiency relating to permeation of a heat medium.

Density of the partition walls is preferably 0.5 to 5 g/cm$^3$. When the density of the partition walls is set to 0.5 g/cm$^3$ or more, it is possible to provide the sufficient strength of the partition wall and to prevent the partition wall from being broken by resistance caused when the first fluid passes through the inside of the flow path (inside the cell). In addition, when the density of the partition walls is set to 5 g/cm$^3$ or less, it is possible to reduce weight of the honeycomb structure. When the density is set within the above-described range, it is possible to strengthen the honeycomb structure and to obtain the effect of improving the thermal conductivity. Incidentally, the density of the partition walls is a value measured by the Archimedes method.

The thermal conductivity of the honeycomb structure is preferably 50 W/(m·K) or more, more preferably 100 to 300 W/(m·K), and particularly preferably 120 to 300 W/(m·K). When the thermal conductivity of the honeycomb structure is set within such a range, the thermal conductivity is favorable, and it is possible to efficiently transfer the heat inside the honeycomb structure to the inner cylinder of the casing. Incidentally, a value of the thermal conductivity is a value measured by a laser flash method.

When the exhaust gas is caused to flow, as the first fluid, to the cell of the honeycomb structure, it is preferable to load a catalyst on the partition walls of the honeycomb structure. When the catalyst is loaded on the partition wall, it is possible to change CO, $NO_x$, HC, and the like in the exhaust gas to harmless substances by catalytic reaction, and further, it is possible to use reaction heat generated during the catalytic reaction for heat exchange. The catalyst preferably contains at least one kind of element selected from the group consisting of noble metals (platinum, rhodium, palladium, ruthenium, indium, silver, and gold), aluminum, nickel, zirconium, titanium, cerium, cobalt, manganese, zinc, copper, tin, iron, niobium, magnesium, lanthanum, samarium, bismuth, and barium. The above-described element may be contained as simple metal, metal oxides, or other metal compounds.

A loading amount of the catalyst (catalyst metal+carrier) is preferably 10 to 400 g/L. In addition, the loading amount is preferably 0.1 to 5 g/L in the case of the catalyst containing noble metal. When the loading amount of the catalyst (catalyst metal+carrier) is set to 10 g/L or more, the catalytic action easily occurs. On the other hand, when the loading amount of the catalyst is set to 400 g/L or less, it is possible to suppress the pressure loss and to suppress an increase in manufacturing cost. The carrier is a carrier on which the catalyst metal is loaded. The carrier preferably contains at least one kind selected from a group consisting of alumina, ceria, and zirconia.

There is no particular limitation on a shape of the casing as long as it is configured such that the inner cylinder is arranged so as to be fitted to the outer circumferential face of the honeycomb structure, the middle cylinder is arranged so as to cover the inner cylinder, and the outer cylinder covers the middle cylinder.

There is no particular limitation on a material of the casing. Examples of the material of the casing include metals, ceramic, and the like. For example, stainless steel, titanium alloy, copper alloy, aluminum alloy, brass, or the like can be used as the metal. In addition, when the heat exchange component is used to recover the exhaust heat from the exhaust gas of the engine, or the like, both end portions of the casing may be configured to be connectable to a pipe through which the exhaust gas of the engine passes. When an inner diameter of the pipe through which the exhaust gas passes differs from each inner diameter of the both end portions of the casing, a gas introduction pipe whose inner diameter gradually increases or decreases may be provided between the pipe and the casing, or the pipe and the casing may be directly connected to each other. When the pipe and the casing are directly connected to each other without providing the gas introduction pipe, the second fluid inside the inner circumferential flow path easily boils and vaporizes as the exhaust gas hits the inner circumferential flow path of the casing, thereby improving the heat shielding property.

There is no particular limitation on the first fluid. When the heat exchange component is used as a part of a heat exchanger mounted on an automobile, the first fluid is preferably an exhaust gas.

There is no particular limitation on the second fluid. When the heat exchange component is used as a part of the heat exchanger mounted on the automobile, the second fluid is preferable water or antifreeze solution (LLC specified in JIS K 2234).

Figure 3A:
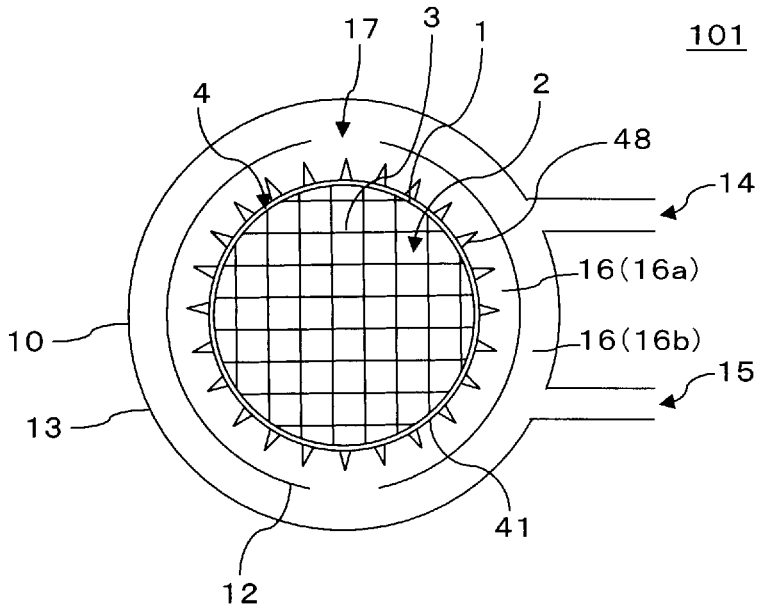
FIG. 3A is a schematic cross-sectional view showing another embodiment of the heat exchange component of the present invention, and is the cross-sectional view showing a cross section orthogonal to an extending direction of a cell of a honeycomb structure.
Figure 3B:
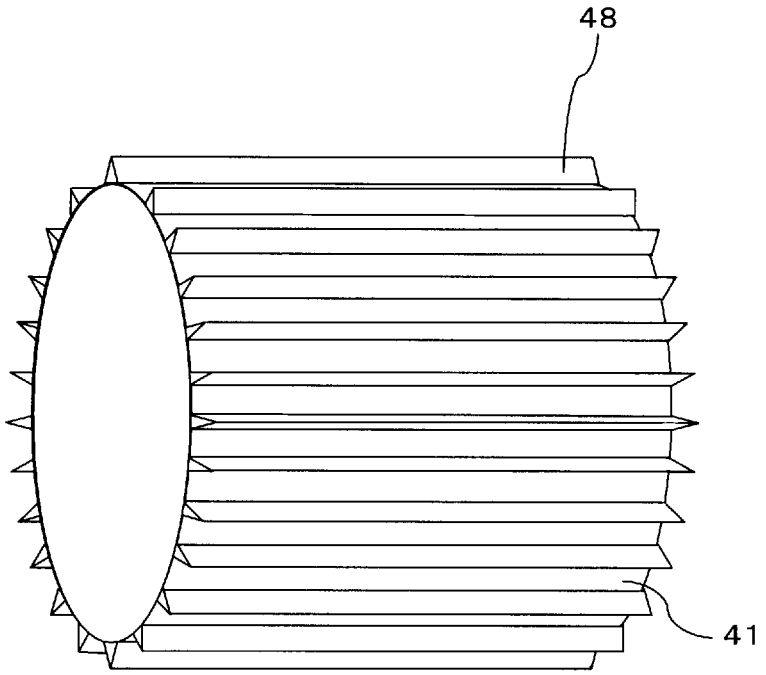
FIG. 3B is a schematic perspective view showing an inner cylinder according to another embodiment of the heat exchange component of the present invention.

Next, another embodiment of the heat exchange component of the present invention will be described. The heat exchange component according to the present embodiment is a heat exchange component 101 as shown in FIGS. 3A and 3B. FIG. 3A is a schematic cross-sectional view showing another embodiment of the heat exchange component of the present invention, and is the cross-sectional view showing a cross section orthogonal to an extending direction of a cell of a honeycomb structure. FIG. 3B is a schematic perspective view showing an inner cylinder according to another embodiment of the heat exchange component of the present invention. Configurations other than the inner cylinder is not shown in FIG. 3B. That is, FIG. 3B shows only the inner cylinder and fins formed in the inner cylinder. In FIGS. 3A and 3B, the same constituent elements as those of the heat exchange component 100 shown in FIGS. 1 to 2B will be denoted by the same reference numerals, and the description thereof will be omitted in some cases.

As shown in FIGS. 3A and 3B, the heat exchange component 101 according to another embodiment has the same configuration as the heat exchange component 100 shown in FIGS. 1 to 2B except that a fin 48 is formed on a face (outer circumferential face of an inner cylinder 41) of the inner cylinder 41 that is not in contact with the honeycomb structure 1. When the fin 48 is formed on the inner cylinder 41 in this manner, a surface area of the inner cylinder 41 increases, and it is possible to increase speed of heat exchange between the first fluid and the second fluid. In addition, a temperature change of the first fluid is easily transmitted to the second fluid passing through the inner circumferential flow path 16*a*, and thus, the temperature of the second fluid rapidly rises and falls, and it is also possible to advance a timing of switching between promotion and suppression of heat exchange. Incidentally, the fin 48 formed in the inner cylinder 41 is not in contact with the middle cylinder 12 in the heat exchange component 101.

In addition, since the fin 48 is formed in the inner cylinder 41, it is possible to promote heat dissipation of the inner cylinder 41 and to suppress an excessive temperature rise of the inner cylinder 41 when the second fluid is in the gaseous state.

There is no particular limitation on a shape of the fins as long as the fins are formed on the face of the inner cylinder where the fins are not in contact with the honeycomb structure so as to increase the surface area of the portion of the inner cylinder fitted with the honeycomb structure and so as not to be in contact with the middle cylinder. Examples of the shape of the fins may include a shape in which protrusions are formed on the inner cylinder and the protrusions extend in a straight line, a curved line, a spiral shape, or the like, a shape in which protrusions are formed on the inner cylinder and the protrusions extend in a dotted line, and the like.

A surface area of the fins is preferably an area corresponding to 10% or more of a surface area of the inner cylinder excluding the fins, more preferably an area corresponding to 20% or more thereof, and particularly preferably an area corresponding to 30% or more thereof. Here, the "surface area of the inner cylinder excluding the fins" is a surface area in a case where the inner cylinder is a cylindrical body having a constant thickness. Incidentally, when the inner cylinder is the cylindrical body having the constant thickness, a thickness of the inner cylinder is a thickness of the thinnest portion of the thickness of the inner cylinder. With such a configuration, it is possible to improve the speed of heat exchange that is performed between the first fluid and the second fluid. The portion of the inner cylinder to be fitted with the honeycomb structure is a portion of the inner cylinder present between a first straight line and a second straight line when drawing the first straight line passing through a first end face of the honeycomb structure and the second straight line passing through a second end face in a cross-section parallel to the cell extending direction.

There is no particular limitation on a material of the fin. The fin may be formed to be integrated with the inner cylinder or may be attached to the inner cylinder. The fin is preferably formed to be integrated with the inner cylinder from the viewpoint of ease of manufacture. For example, the fin may be formed on the inner cylinder by performing embossing processing or the like on the inner cylinder.

Figure 4:
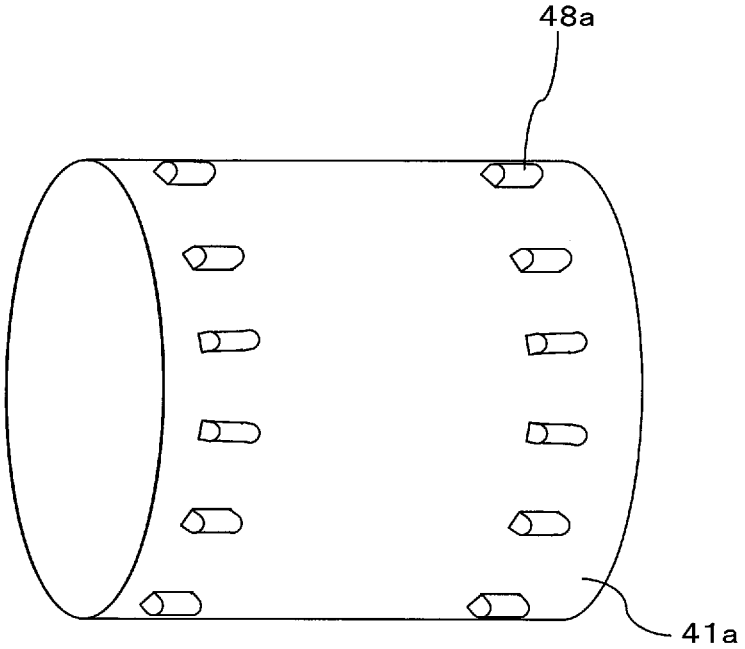
FIG. 4 is a schematic perspective view showing an inner cylinder according to still another embodiment of the heat exchange component of the present invention.

In addition, a fin 48*a* may be formed only on both end portion sides of the honeycomb structure 1 (see FIG. 3A) of the inner cylinder 41*a* on a face (outer circumferential face of an inner cylinder 41*a*) which is not in contact with the honeycomb structure 1 (see FIG. 3A) as shown in FIG. 4. FIG. 4 is a schematic perspective view showing the inner cylinder according to still another embodiment of the heat exchange component of the present invention. FIG. 4 shows only the inner cylinder and the fins formed in the inner cylinder.

(Method of Manufacturing Heat Exchange Component)

Next, a method of manufacturing the heat exchange component will be described. The heat exchange component of the present invention can be manufactured, for example, as follows. First, a kneaded material containing ceramic powder is extruded into a desired shape to prepare a honeycomb formed body. It is possible to use the above-described ceramic as the material of the honeycomb structure. For example, in the case of manufacturing a honeycomb structure containing Si-impregnated SiC composite material as a main component, it is possible to obtain the honeycomb formed body having a desired shape by adding a binder and water or an organic solvent to a predetermined amount of SiC powder, kneading the resultant mixture to form a kneaded material, and molding the kneaded material. Further, the obtained honeycomb formed body is dried, and the honeycomb formed body is impregnated with metal Si and fired in a pressure-reduced inert gas or in vacuum, whereby it is possible to obtain the honeycomb structure in which the plurality of cells serving as the flow paths of the first fluid are defined and formed by the partition walls.

Next, the honeycomb structure is inserted into the inner cylinder made of stainless steel, and the inner cylinder is arranged so as to be fitted to the honeycomb structure by shrink fitting. Incidentally, press fitting, brazing, diffusion bonding, or the like may be used for fitting between the honeycomb structure and the inner cylinder other than the shrink fitting.

Next, a casing member, which is made of stainless steel, has the middle cylinder and the outer cylinder, and serves as a part of the casing, is manufactured. The casing member has a double-pipe structure in which a part (outer circumferential flow path) of the circumferential flow path, which serves as the flow path of the second fluid, is formed between the middle cylinder and the outer cylinder. At least one open end is formed in the middle cylinder of the casing member so as to penetrate front and back surfaces side of the middle cylinder. This open end serves as the communication hole communicating the inner circumferential flow path and the outer circumferential flow path in the heat exchange component. In addition, it is preferable to form the inlet of the second fluid and the outlet of the second fluid in the outer cylinder of the casing member.

Next, the honeycomb structure and the inner cylinder arranged so as to be fitted to the honeycomb structure are arranged inside the prepared casing member. At this time, a gap configured to form the inner circumferential flow path is formed between the middle cylinder of the casing member and the inner cylinder. Next, the casing member and the inner cylinder are bonded to each other to prepare the casing that includes the inner cylinder arranged so as to be fitted to the outer circumferential face of the honeycomb structure, the middle cylinder arranged so as to cover the inner cylinder, and the outer cylinder arranged so as to cover the middle cylinder.

With such a configuration, it is possible to manufacture the heat exchange component of the present invention. However, the method of manufacturing the heat exchange component of the present invention is not limited to the manufacturing method that has been described so far. For example, the heat exchange component may be manufactured by preparing a casing that includes an inner cylinder, a middle cylinder, and an outer cylinder before fitting the honeycomb structure and the inner cylinder to each other and arranging the honeycomb structure inside the inner cylinder of the prepared casing.

EXAMPLE

Hereinafter, the present invention will be described in more detail with Examples, but the present invention is not limited by these Examples at all.

Heat exchange components according to Example 1 and Comparative Example 1 were manufactured as follows.

Example 1

(Manufacture of Honeycomb Structure)

A kneaded material containing SiC powder was extruded into a desired shape, and then, dried, processed to have a predetermined outer shape dimension, and impregnated with Si and fired to produce a round pillar-shaped honeycomb structure. In the honeycomb structure, a diameter (outer shape) of an end face was 55.4 mm, and a length in an extending direction of a cell was 40 mm. The cell density of the honeycomb structure was 23 cells/cm$^2$, and a thickness (wall thickness) of a partition wall was 0.3 mm. The thermal conductivity of the honeycomb structure was 150 W/(m·K).

(Manufacture of Heat Exchange Component)

Next, an inner cylinder made of stainless steel was prepared. The inner cylinder had a cylindrical shape having an inner diameter of 55.2 mm and an axial length of 44 mm, and had a wall thickness of 1.0 mm. Next, the honeycomb structure was inserted into the prepared inner cylinder, and the inner cylinder was arranged so as to be fitted to an outer circumferential face of the honeycomb structure by shrink fitting.

Next, a casing member made of stainless steel and including a middle cylinder and an outer cylinder was prepared. The middle cylinder had a cylindrical shape having an inner diameter of 59.2 mm and an axial length of 42.5 mm, and had a wall thickness of 1.5 mm. The outer cylinder had a cylindrical shape having an inner diameter of 66.2 mm and an axial length of 47 mm, and had a wall thickness of 1.5 mm. Four communication holes each of which communicate the inside and the outside of the middle cylinder and has an opening area of 3.14 mm$^2$ were formed in the middle cylinder. Two formation positions of the communication holes were set in each of a first region and a second region in a cross section of the heat exchange component orthogonal to the extending direction of the cell of the honeycomb structure. In addition, an inlet for introduction of a second fluid serving as a heat medium and an outlet for emission of the second fluid were formed in the outer cylinder.

Next, the inner cylinder to which the honeycomb structure is fixed by fitting was arranged inside the middle cylinder of the prepared casing member, and the middle cylinder and the inner cylinder were bonded to each other by welding, thereby manufacturing the heat exchange component that includes the honeycomb structure and the casing. An inner circumferential flow path having a distance of 1 mm between the inner cylinder and the middle cylinder was formed in a radial direction of the honeycomb structure between the inner cylinder and the middle cylinder of the casing. In addition, an outer circumferential flow path having a distance of 2.7 mm between the middle cylinder and the outer cylinder was formed in the radial direction of the honeycomb structure between the middle cylinder and the outer cylinder of the casing. The communication hole formed in the middle cylinder was positioned in a portion of the casing that covers the honeycomb structure, and the inner circumferential flow path and the outer circumferential flow path communicate with each other through this communication hole.

(Heat Exchange Test)

A heat exchange test was conducted for the prepared heat exchange component by the following method. That is, the amount of input heat flowing into the heat exchange component, the heat recovery amount recovered by the heat exchange component and the temperature of the middle cylinder were measured while causing a first fluid serving as one heat medium to pass through the cell formed in the honeycomb structure and causing a second fluid serving as another heat medium to pass through the circumferential flow path of the casing. Specifically, first, the first fluid at 400° C. and the second fluid at 80° C. were caused to pass through the heat exchange component for five minutes. Next, the first fluid and the second fluid were caused to pass through the heat exchange component while sequentially raising the temperature of the first fluid and the second fluid up to 800° C. and 100° C., respectively. Next, the first fluid at 800° C. and the second fluid at 100° C. were caused to pass through the heat exchange component for five minutes. Next, the first fluid and the second fluid were caused to pass through the heat exchange component while sequentially lowering the temperature of the first fluid and the second fluid up to 400° C. and 80° C., respectively. Then, the first fluid at 400° C. and the second fluid at 80° C. were caused to pass through the heat exchange component for five minutes. Air was used as the first fluid, and water was used as the second fluid. Then, the heated air was caused to pass through the cell at a flow rate of 10 g/sec, and water was caused to pass through the circumferential flow path at a flow rate of 10 L/min. In addition, the heat exchange test measurement as the "measurement of the heat input amount flowing into the heat exchange component, the heat recovery amount recovered from the heat exchange component, and the middle cylinder temperature" was conducted under three states of a first low temperature condition, a first high temperature condition, and a second low temperature condition to be described later. The first low temperature condition was a condition obtained immediately after causing the first fluid at 400° C. and the second fluid at 80° C. to pass through the heat exchange component for five minutes. The first high temperature condition was a condition obtained immediately after causing the first fluid at 800° C. and the second fluid at 100° C. to pass through the heat exchange component for five minutes. The second low temperature condition was a condition obtained after the first high temperature condition and immediately after causing the first fluid at 400° C. and the second fluid at 80° C. to pass through the heat exchange component for five minutes. Results of the heat exchange test measurement under the first low temperature condition and the second low temperature condition were the same. Table 1 and Table 2 show the results of the heat exchange test measurement under the first low temperature condition (the second low temperature condition) and the first high temperature condition, respectively. Table 1 shows the results of the heat exchange test measurement under the first low temperature condition (the second low temperature condition), and Table 2 shows the results of the heat exchange test measurement under the first high temperature condition. Incidentally, the heat input amount and the heat recovery amount were measured using a heat exchanging member evaluation apparatus manufactured by ON Sogo Denki Co., Ltd.

The heat input amount can be obtained as a product of a "temperature difference between the first fluid and the second fluid before passing through the heat exchange component", a "specific heat capacity of the first fluid", and a "mass flow rate of the first fluid". Incidentally, the "temperature difference between the first fluid and the second fluid before passing through the heat exchange component" is a value obtained by subtracting temperature of the second fluid immediately before flowing into the heat exchange component from temperature of the first fluid immediately before flowing into the heat exchange component. In addition, the heat recovery amount can be obtained as a product of a "temperature difference of the second fluid before and after passing through the heat exchange component", a "specific heat capacity of the second fluid", and a "mass flow rate of the second fluid". Incidentally, the "temperature difference of the second fluid before and after passing through the heat exchange component" is a value obtained by subtracting temperature of the second fluid immediately before flowing into the heat exchange component from temperature of the second fluid immediately after flowing out of the heat exchange component.

TABLE 1

| | Heat input amount (kW) | Heat recovery amount (kW) | Middle cylinder temperature (° C.) |
|---|---|---|---|
| Example 1 | 3.4 | 1.13 | 98 |
| Comparative Example 1 | 3.4 | 1.34 | 99 |

TABLE 2

| | Heat input amount (kW) | Heat recovery amount (kW) | Middle cylinder temperature (° C.) |
|---|---|---|---|
| Example 1 | 29 | 1.1 | 380 |
| Comparative Example 1 | 29 | 4.6 | 106 |

Comparative Example 1

The same honeycomb structure as that in Example 1 was prepared, and an inner cylinder made of stainless steel was arranged so as to be fitted to the honeycomb structure. Further, the honeycomb structure and the inner cylinder arranged so as to be fitted to the honeycomb structure were arranged in a casing member made of stainless steel and including an outer cylinder, thereby manufacturing a heat exchange component including the honeycomb structure and the casing. The casing member according to Comparative Example 1 was not provided with a middle cylinder, and thus, a circumferential flow path thereof did not include an inner circumferential flow path and an outer circumferential flow path. The above-described heat exchange test was also conducted for the heat exchange component according to Comparative Example 1 in the same manner as in Example 1. Results are shown in Table 1 and Table 2. Incidentally, temperature of the outer cylinder was measured instead of the middle cylinder temperature since the heat exchange component according to Comparative Example 1 was not provided with the middle cylinder.

Results

Example 1

The heat exchange component according to Example 1 showed substantially the same level of the heat recovery amount and substantially the same middle cylinder temperature as those of the heat exchange component according to Comparative Example 1 under the first low temperature condition and the second low temperature condition. On the other hand, the middle cylinder temperature of the heat exchange component according to Example 1 was 380° C., and the middle cylinder temperature of the heat exchange component according to Comparative Example 1 was 106° C. under the first high temperature condition. In addition, the heat recovery amount by the heat exchange component according to Example 1 under the first high temperature condition was smaller than the heat recovery amount by the heat exchange component according to Example 1 under the first low temperature condition and the second low temperature condition.

Comparative Example 1

The heat recovery amount of the heat exchange component according to Comparative Example 1 under the first high temperature condition was larger than that the heat recovery amount thereof under the first low temperature condition and the second low temperature condition. In addition, the heat recovery amount of the heat exchange component according to Comparative Example 1 under the first high temperature condition was 3 times or more of the heat recovery amount of the heat exchange component according to Comparative Example 1 under the first low temperature condition and the second low temperature condition.

As described above, it is considered that the inner circumferential flow path of the heat exchange component according to Example 1 is filled with water vapor, and the water vapor in the inner circumferential flow path becomes a heat insulating material so that heat exchange is suppressed under the first high temperature condition. In addition, the same results as those under the first low temperature condition were obtained under the second low temperature condition of Example 1. Thus, it is considered that suppression of heat exchange and promotion of heat exchange are switched without external control.

Example 2

A mesh member was provided at a location where a communication hole was formed in the middle cylinder between the inner cylinder and the middle cylinder of the heat exchange component according to Example 1, thereby preparing a heat exchange component according to Example 2. The mesh member having a sieve opening of 0.13 mm was used.

A heat exchange test was conducted for the heat exchange component according to Example 1 and the heat exchange component according to Example 2 under the same conditions. In the heat exchange test, the test was conducted at three points of water temperature of 40° C., 60° C., and 80° C. When the water temperature was 40° C. and 60° C., no significant change in temperature efficiency was observed.

When the water temperature was 80° C., a decrease in temperature efficiency of the heat exchange component according to Example 2 was observed as compared with that of the heat exchange component according to Example 1. Therefore, it was understood that the heat exchange component according to Example 2 provided with the mesh member is excellent in heat shielding property.

In addition, verification of a boiling sound of the second fluid at the time of heat shielding was conducted for the heat exchange component according to Example 1 and the heat exchange component according to Example 2 under the following conditions. Air was used as the first fluid, and water was used as the second fluid. The heated air at 700° C. was caused to pass through the cell of the honeycomb structure at a flow rate of 20 g/sec, and water was caused to pass through the circumferential flow path at a flow rate of 10 L/min. The verification of the boiling sound was conducted at four points of water temperature of 40° C., 60° C., 80° C. and 90° C. In the heat exchange component according to Example 1, there was almost no boiling sound when the water temperature was 40° C., and the boiling sound became large as the water temperature was raised to 60° C. and 80° C. On the other hand, when the water temperature was 40° C., 60° C. and 80° C. in the heat exchange component according to Example 2, the boiling sound was smaller than the state of Example 1 at the water temperature of 60° C. From the above-described results, the heat exchange component according to Example 2 had the reduced boiling sound at the time of evaporation of the second fluid as compared with the heat exchange component according to Example 1.

Examples 3 and 4

A heat exchange component, configured in the same manner as that of Example 1 except that a distance between an inner cylinder and a middle cylinder was set to 0.5 mm, was prepared as a heat exchange component according to Example 3. A heat exchange component, configured in the same manner as that of Example 1 except that a distance between an inner cylinder and a middle cylinder was set to 0.3 mm, was prepared as a heat exchange component according to Example 4.

A heat exchange test was conducted for the heat exchange component according to Example 3 and the heat exchange component according to Example 4 under the same conditions. In the heat exchange test, the test was conducted at four points of water temperature of 40° C., 60° C., 80° C., and 90° C. It was understood that the heat exchange component according to Example 4 in which the distance between the inner cylinder and the middle cylinder was set to 0.3 mm had the improved heat recovery amount when the water temperature was low as compared with the heat exchange component according to Example 3. Specifically, the both had the same level of the heat recovery amount when the water temperature was 90° C., but the heat recovery amount of the heat exchange component according to Example 4 was improved as the temperature was lowered to 80° C., 60° C., and 40° C. Thus, it was understood that it is possible to improve the heat recovery amount at low water temperature without increasing the heat recovery amount at high water temperature by decreasing the distance between the inner cylinder and the middle cylinder.

INDUSTRIAL APPLICABILITY

The heat exchange component of the present invention can be used for heat exchange between the first fluid and the second fluid. When used to recover the exhaust heat from the exhaust gas in the automotive field, the heat exchange component can serve to improve fuel efficiency of automobiles.

DESCRIPTION OF REFERENCE NUMERALS

1: honeycomb structure, 2: cell, 3: partition wall, 4: outer circumferential face, 10: casing, 11, 41, 41*a*: inner cylinder, 12: middle cylinder, 13: outer cylinder, 14: inlet (inlet of second fluid), 15: outlet (outlet of second fluid), 16: circumferential flow path, 16*a*: inner circumferential flow path (circumferential flow path), 16*b*: outer circumferential flow path (circumferential flow path), 17: communication hole, 18: mesh member, 48, 48*a*: fin, F1: second fluid (second fluid in liquid state), F2: second fluid (second fluid in gaseous state), E: first fluid, 100, 101, 102, 103: heat exchange component.

The invention claimed is:

1. A heat exchange component comprising:

a pillar-shaped honeycomb structure including a partition wall containing ceramic as a main component; and a casing arranged so as to cover an outer circumferential face of the honeycomb structure, wherein a plurality of cells extending from a first end face to a second end face and serving as flow paths of a first fluid are defined and formed by the partition wall in the honeycomb structure, the casing, as a cylinder covering the outer circumferential face of the honeycomb structure, consists of: an inner cylinder arranged so as to be fitted to the outer circumferential face of the honeycomb structure, a middle cylinder arranged so as to cover the inner cylinder, and an outer cylinder arranged so as to cover the middle cylinder such that a circumferential flow path serving as a flow path of a second fluid is formed between the inner cylinder and the outer cylinder, an inlet configured to introduce the second fluid and an outlet configured to emit the second fluid are formed in the outer cylinder of the casing, the circumferential flow path includes an inner circumferential flow path formed between at least a part of the inner cylinder and at least a part of the middle cylinder and an outer circumferential flow path formed between at least a part of the middle cylinder and at least a part of the outer cylinder, a portion of the outer circumferential flow path includes a flow path which communicates between the inlet and the outlet without communicating via the inner circumferential flow path, and at least one communication hole that communicates the inner circumferential flow path and the outer circumferential flow path is formed in a portion of the middle cylinder that covers the honeycomb structure.

2. The heat exchange component according to claim 1, wherein a ratio of an opening area of the at least one communication hole formed in the portion of the middle cylinder that covers the honeycomb structure relative to an area of the portion of the middle cylinder that covers the honeycomb structure is 50% or less.

3. The heat exchange component according to claim 1, wherein a plurality of the communication holes are formed in the portion of the middle cylinder that covers the honeycomb structure.

4. The heat exchange component according to claim 3, wherein an opening area of at least one of the communication holes is 0.5 to 5000 $mm^2$.

5. The heat exchange component according to claim 1, wherein a distance between the inner cylinder and the middle cylinder in a radial direction of the honeycomb structure is a length corresponding to 0.1 to 10% of a diameter of the honeycomb structure.

6. The heat exchange component according to claim 1, wherein a mesh member is arranged at a location where the at least one communication hole is formed in the middle cylinder between the inner cylinder and the middle cylinder.

7. The heat exchange component according to claim 1, wherein the at least one communication hole is formed at a position corresponding to an end portion of the honeycomb structure.

8. The heat exchange component according to claim 7, wherein the at least one communication hole is formed in an annular shape so as to surround an outer circumference of the honeycomb structure.

* * * * *